US007900919B2

(12) United States Patent
Ledgerwood et al.

(10) Patent No.: US 7,900,919 B2
(45) Date of Patent: Mar. 8, 2011

(54) SHEET TRANSPORT ROLLER SYSTEM

(75) Inventors: Adam Douglas Ledgerwood, Geneva, NY (US); Timothy Gordon Shelhart, West Henrietta, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/139,718

(22) Filed: Jun. 16, 2008

(65) Prior Publication Data

US 2009/0309299 A1 Dec. 17, 2009

(51) Int. Cl.
*B65H 5/02* (2006.01)
*B65H 5/04* (2006.01)

(52) U.S. Cl. ..... 271/274; 271/272; 271/273

(58) Field of Classification Search ..... 271/272–274
See application file for complete search history.

(56) References Cited

U.S. PATENT DOCUMENTS

| | | | | |
|---|---|---|---|---|
| 4,346,883 | A * | 8/1982 | Speraggi | 271/274 |
| 4,611,939 | A * | 9/1986 | Fujiwara | 400/637 |
| 4,990,003 | A * | 2/1991 | Jingu et al. | 400/56 |
| 5,114,251 | A | 5/1992 | Mahoney | |
| 5,199,702 | A * | 4/1993 | Davis et al. | 271/274 |
| 5,205,551 | A * | 4/1993 | Nagano et al. | 271/225 |
| RE35,026 | E | 8/1995 | Mahoney | |
| 5,474,289 | A * | 12/1995 | Pilling | 271/265.04 |
| 5,531,311 | A | 7/1996 | LeMay et al. | |
| 5,580,042 | A * | 12/1996 | Taniguro et al. | 271/274 |
| 5,594,486 | A * | 1/1997 | Kiyohara | 347/104 |
| 5,683,079 | A * | 11/1997 | Ebrahimi | 271/258.01 |
| 5,988,635 | A * | 11/1999 | Ohshima | 271/274 |
| 6,354,584 | B1 | 3/2002 | Suga et al. | |
| 6,378,858 | B1 | 4/2002 | Suga | |
| 6,494,451 | B2 | 12/2002 | Michel | |
| 6,550,759 | B2 | 4/2003 | Kotaka et al. | |
| 7,431,292 | B2 * | 10/2008 | Goto | 271/272 |
| 7,455,295 | B2 * | 11/2008 | Marx et al. | 271/273 |
| 7,500,670 | B2 * | 3/2009 | Kitazawa | 271/274 |
| 7,523,933 | B2 * | 4/2009 | Linder et al. | 271/274 |
| 7,559,550 | B2 * | 7/2009 | Nam | 271/274 |
| 2002/0130463 | A1 * | 9/2002 | Michel | 271/274 |
| 2005/0098943 | A1 * | 5/2005 | Nam | 271/272 |
| 2006/0012112 | A1 * | 1/2006 | Kitazawa | 271/272 |
| 2006/0261540 | A1 * | 11/2006 | Loiselle et al. | 271/228 |
| 2007/0069456 | A1 * | 3/2007 | Jeong | 271/272 |

FOREIGN PATENT DOCUMENTS

| | | | |
|---|---|---|---|
| JP | 63057452 | A * | 3/1988 |
| JP | 04159940 | A * | 6/1992 |

* cited by examiner

*Primary Examiner* — Stefanos Karmis
*Assistant Examiner* — Prasad V Gokhale
(74) *Attorney, Agent, or Firm* — Pepper Hamilton LLP

(57) ABSTRACT

A sheet transport roller system and methods for reducing sheet skew using a sheet transport roller system are disclosed. A sheet transport roller system for use in a document processing device may include a plurality of idler rollers, a plurality of drive rollers and a load distribution mechanism. Each drive roller may correspond to a corresponding idler roller. The load distribution mechanism may be configured to support the plurality of idler rollers and to equalize normal forces applied by each idler roller towards the corresponding drive roller. The load distribution mechanism may include a center loading spring in contact with the document processing device.

6 Claims, 8 Drawing Sheets

SHEET TRANSPORT ROLLER SYSTEM

BACKGROUND

The present disclosure generally relates to document processing devices and methods for operating such devices. More specifically, the present disclosure relates to methods and systems of limiting sheet skew as sheets are transported by a sheet transport roller system in a document processing device.

Document processing devices typically include one or more sets of nips used to transport media (i.e., sheets) within the device. A nip provides a force to a sheet as it passes through the nip to propel it forward through the document processing device. Depending upon the size of the sheet that is being transported, one or more nips in a set of nips might not contact the sheet as it is being transported.

FIG. 1A depicts a top view of a portion of an exemplary document processing device known in the art. As shown in FIG. 1A, the document processing device 100 includes three sets of nips 105*a-c*, 110*a-c*, and 115*a-c*. The first set of nips 105*a-c* are used to transport a sheet; the second set of nips 110*a-c* are used to perform sheet registration; and the third set of nips 115*a-c* are used to transport a sheet in a process direction. Although three nips are shown for each nip location, additional or fewer nips can be used. In some cases, additional nips are used to account for variations in sheet size during the transport or registration processes.

As shown in FIG. 1B, each nip in a set of nips, such as 115*a-c*, includes a drive roller, such as 125*a-c*, and an idler roller, such as 130*a-c*. A normal force is caused at each nip by loading the idler roller 130*a-c*. Friction with the sheet is used to produce a forward force that propels the sheet. Typically, each idler roller 130*a-c* is mounted independently from the other idler rollers in a set of nips. Furthermore, each idler roller 130*a-c* is typically loaded with a separate spring 135*a-c*. The springs 135*a-c* are used to keep the corresponding idler rollers 130*a-c* in contact with the corresponding drive rollers 125*a-c* as the sheet passes through the nip.

Using a separate spring for each idler roller can increase the cost of a document processing device, particularly when a set of nips includes 3 or more nips. Moreover, mounting each idler roller separately and using separate springs for each idler roller can result in high normal force variations between the nips. For example, if the springs have different tolerances or wear unevenly, a particular nip could apply a greater or lesser force than another nip. As such, walk and skew can result from the application of uneven normal forces among nips in a set of nips.

FIGS. 2A and 2B depict graphs of an amount of skew resulting from springs providing unequal normal forces in a conventional document processing device. As shown in FIG. 2A, a document processing device having a set of nips for which a first spring provides a 3.1% spring variation to a first idler roller and a −3.1% spring variation to a second idler roller with a nominal spring force of 4 Newtons (N) results in a skew angle of approximately $2.48\times10^{-3}$ radians (2.48 milliradians) over a distance of approximately 3 meters. FIG. 2B depicts the effects of a system having a similar spring variation, but with a nominal spring force of 8 N. In such a case, the resulting skew angle is approximately 5.25 milliradians. As such, idler rollers that provide a differential normal force can significantly skew a sheet as it is being transported.

SUMMARY

Before the present systems, devices and methods are described, it is to be understood that this disclosure is not limited to the particular systems, devices and methods described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Thus, for example, reference to a "nip" is a reference to one or more nips and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. Nothing herein is to be construed as an admission that the embodiments described herein are not entitled to antedate such disclosure by virtue of prior invention. As used herein, the term "comprising" means "including, but not limited to."

In an embodiment, a sheet transport roller system for use in a document processing device may include a plurality of idler rollers, a plurality of drive rollers that each correspond to a corresponding idler roller, and a load distribution mechanism configured to support the plurality of idler rollers. The load distribution mechanism may include a center loading spring in contact with the document processing device and may be configured to equalize normal forces applied by each idler roller towards the corresponding drive roller.

In an embodiment, a method of reducing sheet skew in a sheet transport roller system having at least one pair of idler rollers may include connecting each pair of idler rollers to a corresponding idler shaft that is configured to apply a substantially equal normal force to each connected idler roller, pivotally connecting each idler shaft to a load distribution bar that is configured to apply a substantially equal normal force to each connected idler shaft, and pivotally connecting the load distribution bar to a center loading spring.

In an embodiment, a method of reducing sheet skew in a sheet transport roller system may include connecting first and second idler rollers to an idler shaft configured to apply a substantially equal normal force to each connected idler roller, connecting a third idler roller to an idler mount, pivotally connecting the idler shaft and the idler mount to a load distribution bar configured to apply a substantially equal normal force to each of the first, second and third idler rollers, and pivotally connecting the load distribution bar to a center loading spring.

DESCRIPTION OF THE DRAWINGS

Aspects, features, benefits and advantages of the present invention will be apparent with regard to the following description and accompanying drawings, of which.

DETAILED DESCRIPTION

The following terms shall have, for the purposes of this application, the respective meanings set forth below.

A "document processing device" refers to a device that performs an operation in the course of producing, replicating, or transforming a document from one format to another format, such as from an electronic format to a physical format or vice versa. Document processing devices may include, without limitation, printers (using any printing technology, such as xerography, ink-jet, or offset); document scanners or specialized readers such as check readers; mail handling machines; fabric or wallpaper printers; or any device in which an image of any kind is created on and/or read from a moving substrate.

A "sheet transport roller system" refers to a portion of a document processing device used to transport a sheet through at least a portion of the device in a process direction. A sheet transport roller system may include one or more idler rollers and one or more corresponding drive rollers.

A "nip" refers to a location in a document processing device at which a force is applied to a sheet to propel the sheet in a process direction. A nip may include, for example and without limitation, a drive roller and an idler roller.

A "drive roller" refers to a nip component that is designed to propel a sheet in contact with the nip. A drive roller may comprise a compliant material, such as rubber, neoprene or the like. A drive roller may be directly driven via a stepper motor, a DC motor or the like. Alternately, a drive roller may be driven using a gear train, belt transmission or the like.

An "idler roller" refers to a nip component that is loaded against the drive roller. The loading of an idler roller produces a normal force that together with friction between the rollers of the nip and a sheet produces a forward force that propels the sheet in the process direction. An idler roller may comprise a non-compliant material.

A "load distribution mechanism" refers to a portion of a sheet transport roller system configured to distribute a normal force between one or more idler rollers.

A "load distribution bar" refers to a portion of a load distribution mechanism configured to distribute a normal force to one or more idler shafts.

A "center loading spring" refers to one or more springs used to connect a load distribution mechanism to another portion of a document processing device. The center loading spring may be configured to impart a normal force to the load distribution mechanism.

An "idler shaft" refers to a portion of a load distribution mechanism that supports one more idler rollers and is configured to distribute a normal force to the one or more supported idler rollers. The idler shaft may axially support the one or more corresponding idler rollers.

An "idler mount" refers to a portion of a load distribution mechanism that supports one idler roller. The idler mount may axially support the supported idler roller.

Figure 1A:
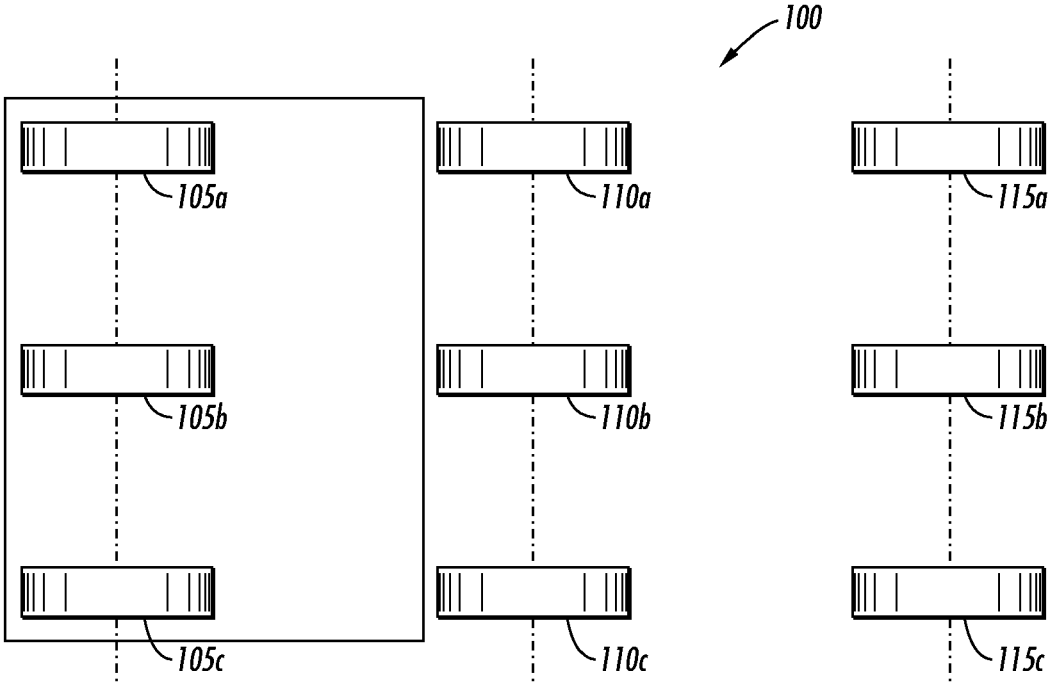
FIG. 1A (PRIOR ART)
FIG. 1A depicts a top view of a portion of a conventional document processing device.
Figure 1B:
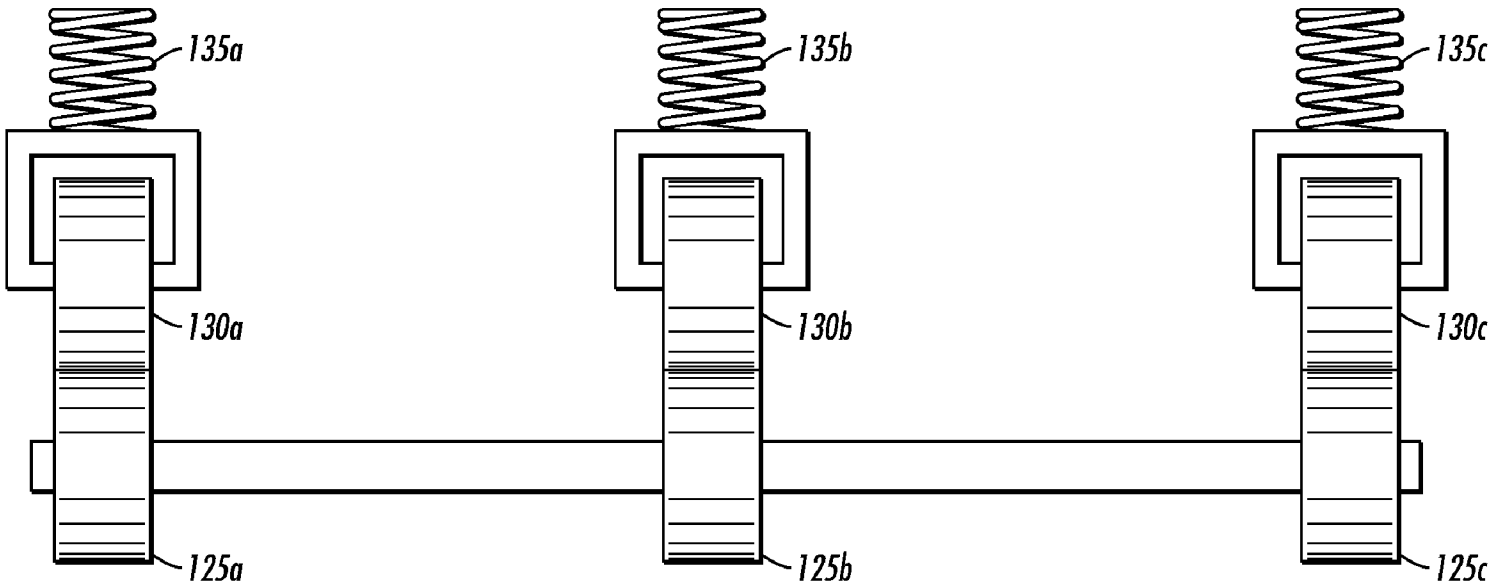
FIG. 1B (PRIOR ART)
FIG. 1B depicts a lateral view of a sheet transport roller system for a conventional document processing device.
Figure 2A:
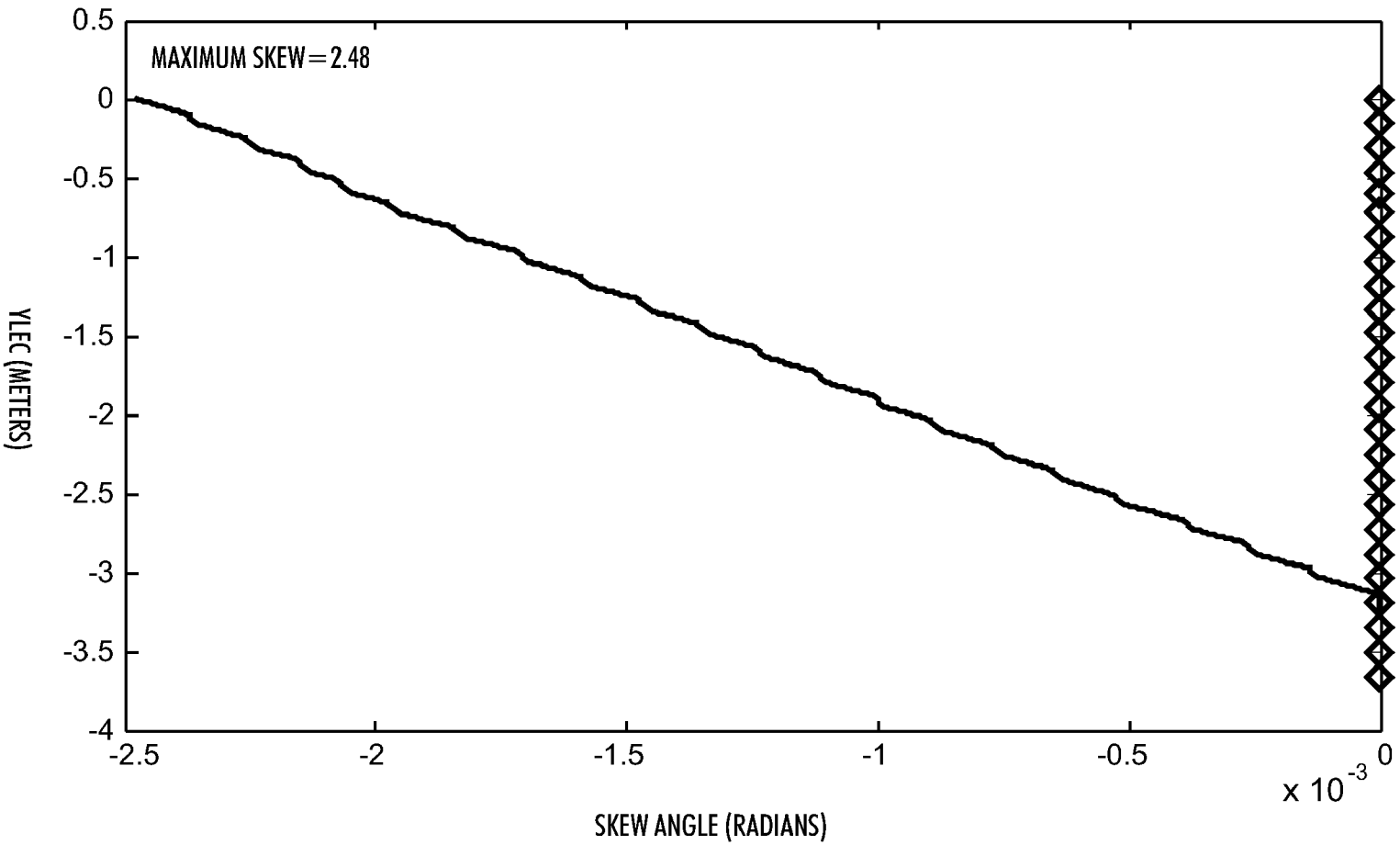
FIGS. 2A-B depict graphs of the amount of skew resulting from unequal springs in a conventional document processing device.
Figure 2B:
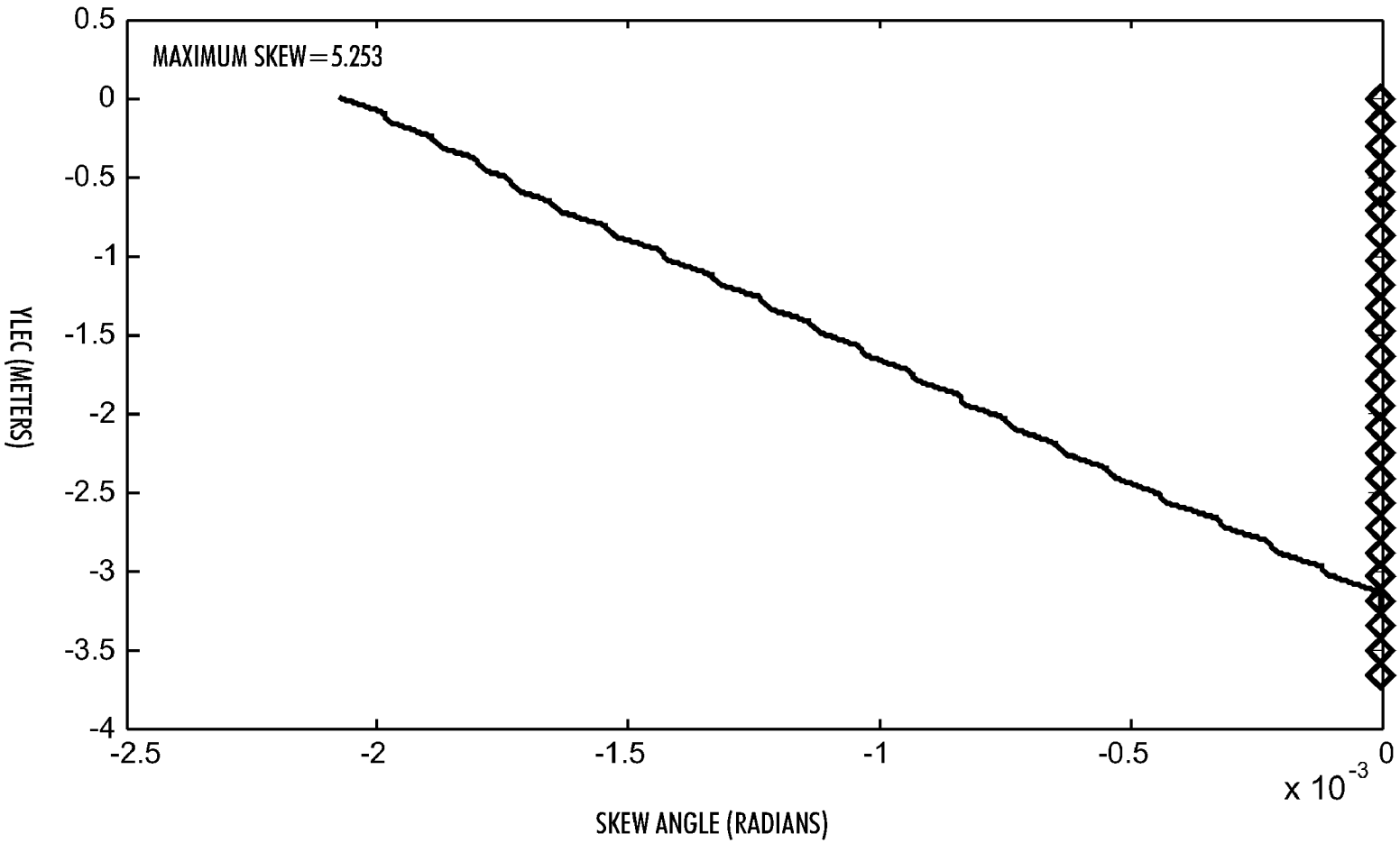
Figure 3:
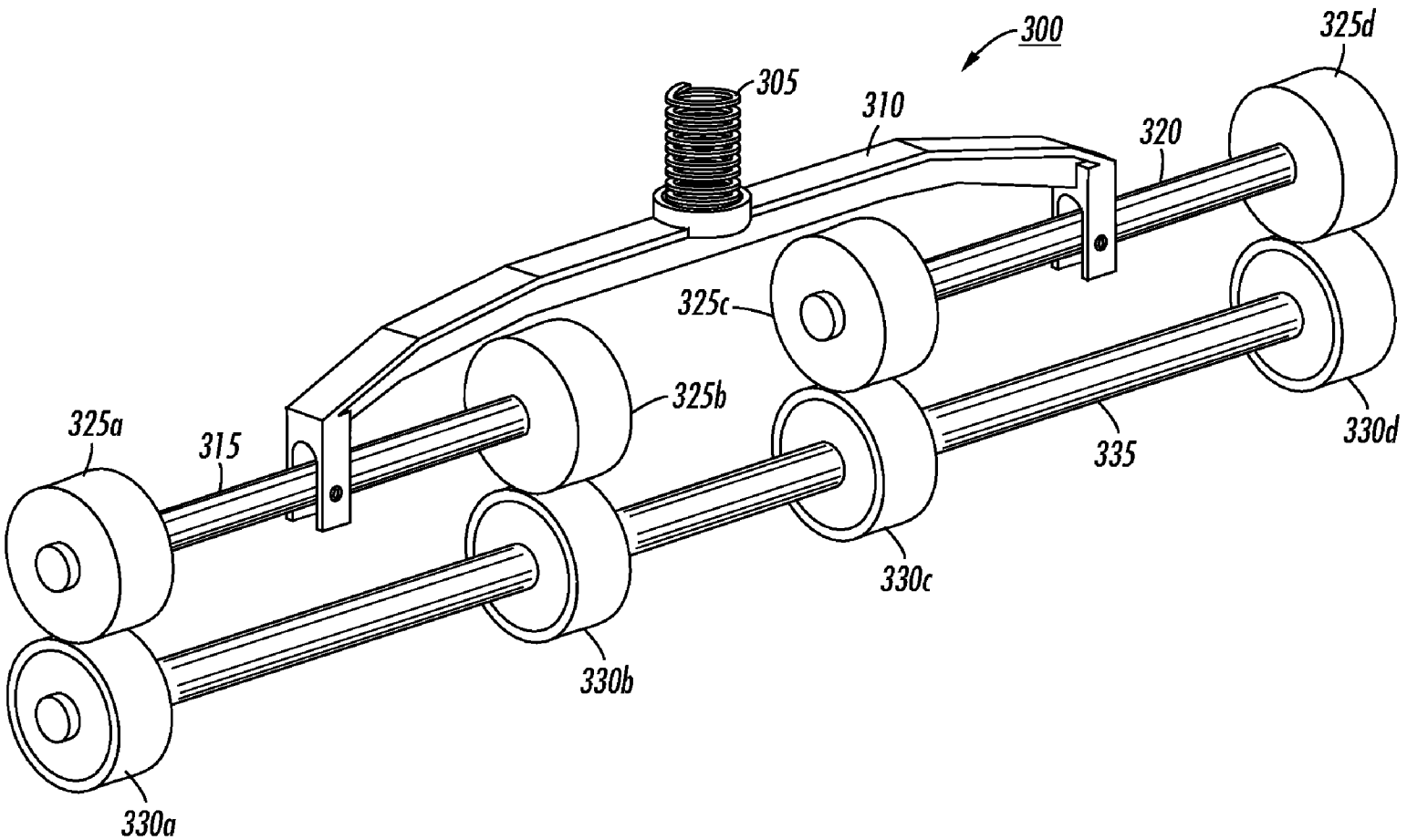
FIG. 3 depicts a lateral view of an exemplary sheet transport roller system for a document processing device according to an embodiment.

FIG. 3 depicts a lateral view of an exemplary sheet transport roller system for a document processing device according to an embodiment. As shown in FIG. 3, a sheet transport roller system 300 may include a center loading spring 305, a load distribution bar 310, a first idler shaft 315, a second idler shaft 320, first, second, third and fourth idler rollers 325*a-d*, respectively, and first, second, third and fourth drive rollers 330*a-d*, respectively.

The center loading spring 305 may provide a normal force that is ultimately distributed among the idler rollers 325*a-d*. The center loading spring 305 may be located substantially at a midpoint of the load distribution bar 310 and provide a pivotal connection between the load distribution bar and another portion of a document processing device (not shown). In an embodiment, the center loading spring 305 is the only spring incorporated into the sheet transport roller system. In an embodiment, the center loading spring 305 may include a plurality of springs used to pivotally connect the load distribution bar 310 to another portion of a document processing device. In an embodiment having a plurality of springs, only a first center loading spring 305 may be connected to the load distribution bar 310, while one or more second springs may be in communication with the first center loading spring 305.

The load distribution bar 310 may be pivotally connected to the center loading spring 305. The load distribution bar 310 may be configured to pivot around a point determined by the location of the connection to the center loading spring 305. The load distribution bar 310 may be further connected to the first idler shaft 315 and the second idler shaft 320 substantially at respective ends of the load distribution bar 310. In an embodiment, the load distribution bar 310 may comprise a substantially rigid material, such as stainless steel, aluminum, and/or another metal, a metallic alloy and/or a rigid plastic that is substantially rigid within an operating temperature range for a document processing device.

The first idler shaft 315 may be pivotally connected to the load distribution bar 310. In an embodiment, the first idler shaft 315 may be configured to pivot around a point determined by a location of the connection to the load distribution bar 310. In an embodiment, the location of the connection to the load distribution bar 310 may be substantially at a midpoint of the first idler shaft 315. The first idler shaft 315 may axially support, for example, the first idler roller 325*a* and the second idler roller 325*b*. In an embodiment, the location of the connection to the load distribution bar 310 may be at a point that is substantially equidistant from the first idler roller 325*a* and the second idler roller 325*b*.

The second idler shaft 320 may be pivotally connected to the load distribution bar 310. In an embodiment, the second idler shaft 320 may be configured to pivot around a point determined by a location of the connection to the load distribution bar 310. In an embodiment, the location of the connection to the load distribution bar 310 may be substantially at a midpoint of the second idler shaft 320. The second idler shaft 320 may axially support, for example, the third idler roller 325*c* and the fourth idler roller 325*d*. In an embodiment, the location of the connection to the load distribution bar 310 may be at a point that is substantially equidistant from the third idler roller 325*c* and the fourth idler roller 325*d*.

In an embodiment, the first idler shaft 315 and the second idler shaft 320 may each comprise a substantially rigid material, such as stainless steel, aluminum, and/or another metal, a metallic alloy and/or a rigid plastic that is substantially rigid within an operating temperature range for a document processing device.

Each idler roller 325*a-d* may be aligned with a corresponding drive roller, such as 330*a-d*, respectively. An idler roller, such as 325*a*, may be configured to provide a normal force against a sheet as it is being transported between the idler roller and the corresponding drive roller 330*a*.

As shown in FIG. 3, each drive roller 330*a-d* for a sheet transport roller system 300 may be axially connected to a common drive shaft 335. As such, each drive roller 330*a-d* may have a substantially equal rotational velocity. Alternate embodiments including a plurality of drive shafts may be used within the scope of the present disclosure.

Referring back to FIG. 3, the sheet transport roller system 300 may be configured to apply a substantially equal normal force at each idler roller 325*a-d*. For example, if the factors affecting the normal force at each idler roller 325*a-d* are equal, portions of the load distribution bar 310, the first idler shaft 315 and the second idler shaft 320 may be substantially parallel to the plane in which sheets are transported through the sheet transport roller system 300. In contrast, if the factors affecting the normal force at one or more idler rollers 325*a-d* are such that the normal force applied by at least one idler roller is less than the normal force applied by at least one other idler roller, one or more of the load distribution bar 310, the first idler shaft 315 and the second idler shaft 320 may pivot such that the resulting normal force applied at each idler roller is substantially equal. As a result, sheet skew may be limited.

Figure 4:
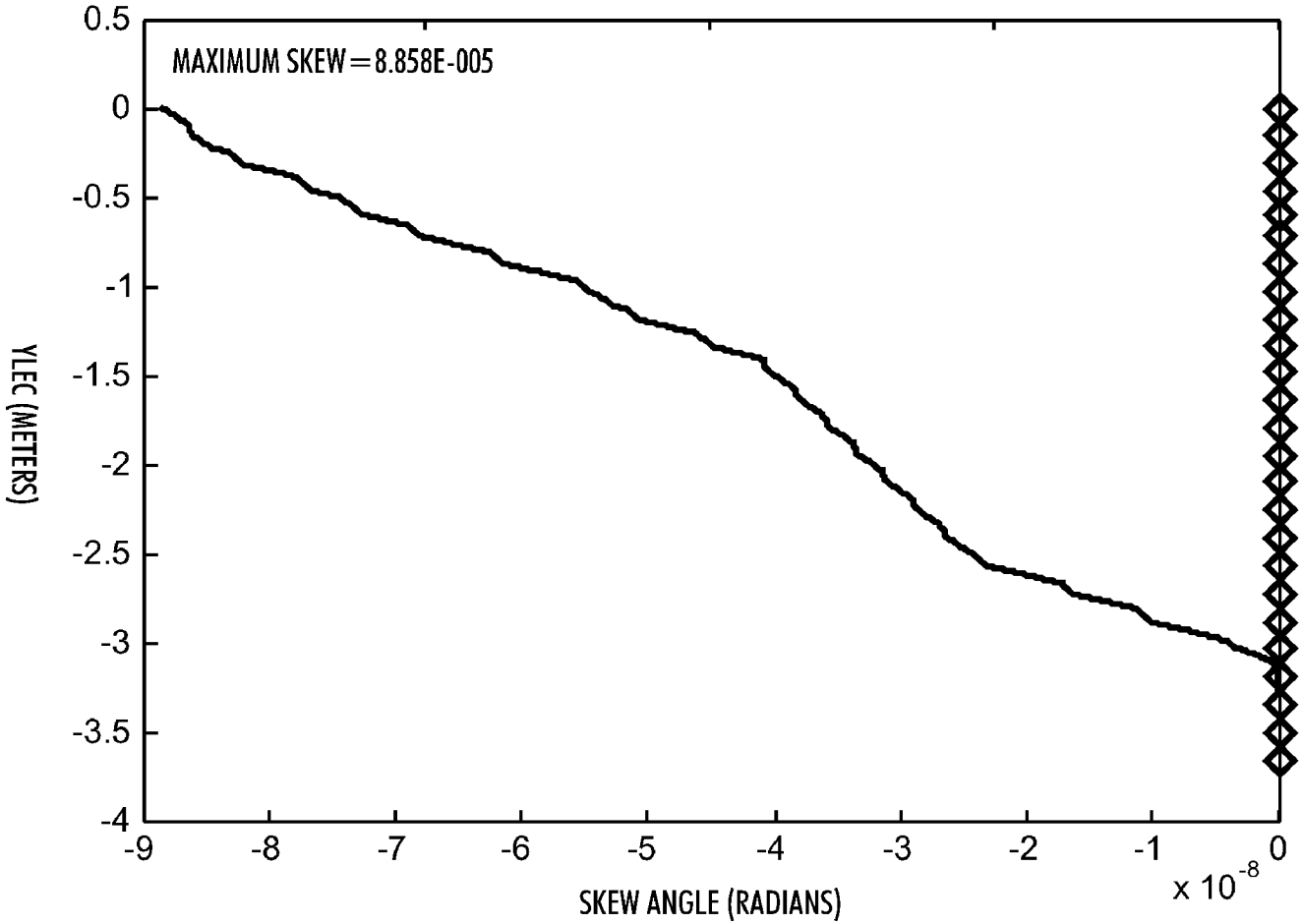
FIG. 4 depicts a graph of the amount of skew resulting from the use of a roller system according to an embodiment.

FIG. 4 depicts a graph of the amount of skew resulting from the use of a sheet transport roller system according to an embodiment. As shown in FIG. 4, a document processing device may include one or more sheet transport roller system providing substantially equal normal force to each idler roller. Having substantially negligible spring force variation between nips resulted in a skew angle of approximately $8.86\times 10^{-8}$ radians (0.0000886 milliradians) over a distance of approximately 3 meters. As such, a sheet transport roller system designed according to the teachings of the present disclosure may effectively result in no sheet skew during normal sheet transport.

Figure 5:
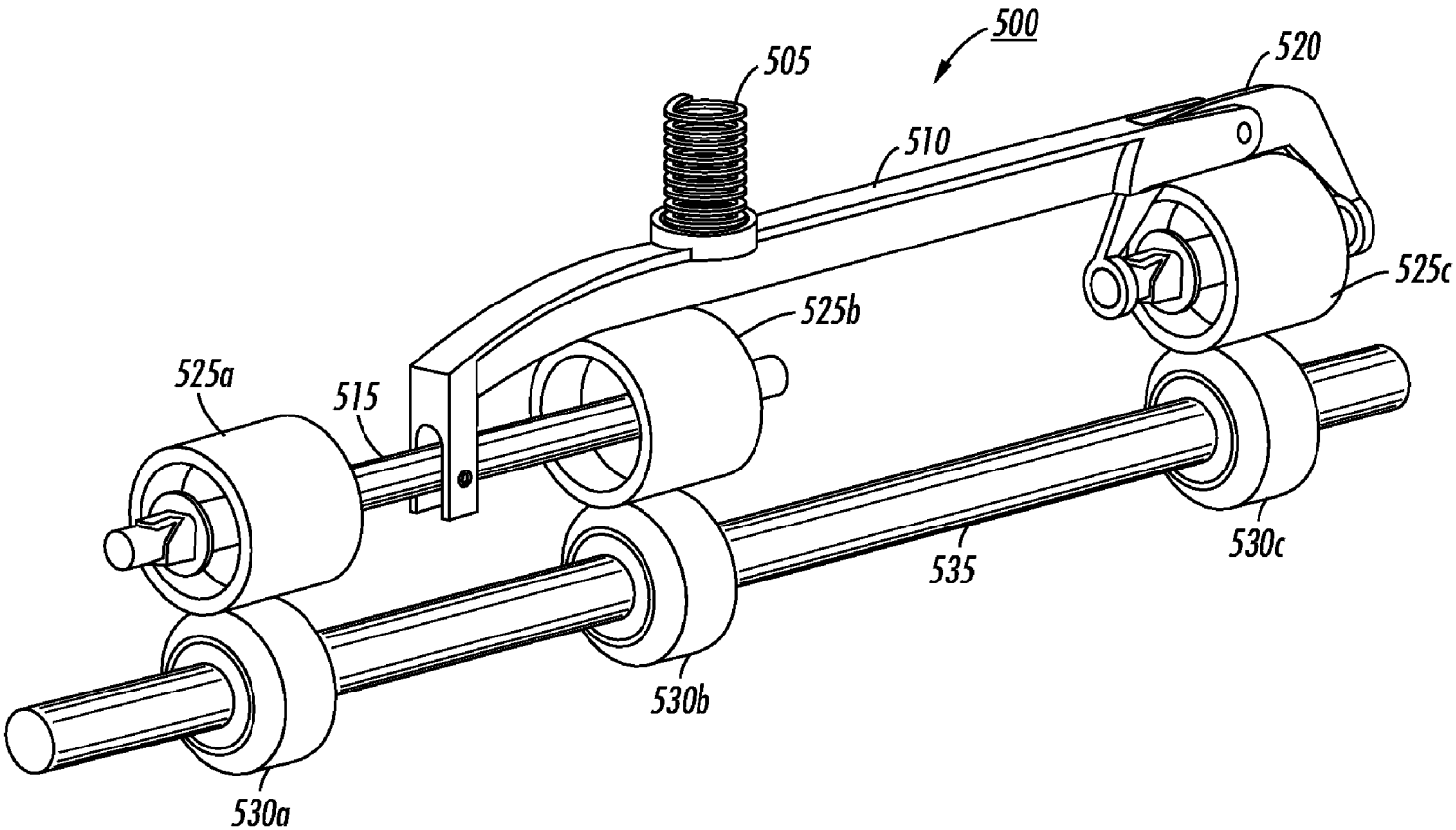
FIG. 5 depicts a lateral view of an alternate exemplary sheet transport roller system for a document processing device according to an embodiment.

FIG. 5 depicts a lateral view of an alternate exemplary sheet transport roller system for a document processing device according to an embodiment. As shown in FIG. 5, a sheet transport roller system 500 may include a center loading spring 505, a load distribution bar 510, an idler shaft 515, an idler mount 520, first, second and third idler rollers 525*a-c*, respectively, and first, second and third drive rollers 530*a-c*, respectively.

The center loading spring 505 may provide a normal force that is ultimately distributed among the idler rollers 525*a-c*. The distance from the connection point between the center loading spring 505 and the load distribution bar 510 to the connection point between the load distribution bar and the idler shaft 515 may be substantially half of the distance from the connection point between the center loading spring and the load distribution bar to the connection point between the load distribution bar and the idler mount 520. The biasing of the center loading spring 505 towards the idler shaft 515 may result in a substantially equal normal force being applied to each idler roller 525*a-c*. Alternate connection points may be used based on the relative sizes of the idler rollers 525*a-c*.

The center loading spring 505 may provide a pivotal connection between the load distribution bar 510 and another portion of a document processing device (not shown). In an embodiment, the center loading spring 505 is the only spring incorporated into the sheet transport roller system 500. In an embodiment, the center loading spring 505 may include a plurality of springs used to pivotally connect the load distribution bar 510 to another portion of a document processing device. In an embodiment having a plurality of springs, only a first center loading spring 505 may be connected to the load distribution bar 510, while one or more second springs may be in communication with the first center loading spring.

The load distribution bar 510 may be pivotally connected to the center loading spring 505. The load distribution bar 510 may be configured to pivot around a point determined by the location of the connection to the center loading spring 505. The load distribution bar 510 may be further connected to the idler shaft 515 and the idler mount 520 substantially at respective ends of the load distribution bar 510. In an embodiment, the load distribution bar 510 may comprise a substantially rigid material, such as stainless steel, aluminum, and/or another metal, a metallic alloy and/or a rigid plastic that is substantially rigid within an operating temperature range for a document processing device.

The idler shaft 515 may be pivotally connected to the load distribution bar 510. In an embodiment, the idler shaft 515 may be configured to pivot around a point determined by a location of the connection to the load distribution bar 510. In an embodiment, the location of the connection to the load distribution bar 510 may be substantially at a midpoint of the idler shaft 515. The idler shaft 515 may axially support, for example, the first idler roller 525*a* and the second idler roller 525*b*. In an embodiment, the location of the connection to the load distribution bar 510 may be at a point that is substantially equidistant from the first idler roller 525*a* and the second idler roller 525*b*.

The idler mount 520 may be pivotally connected to the load distribution bar 510. In an embodiment, the idler mount 520 may be configured to pivot around a point determined by a location of the connection to the load distribution bar 510. In an embodiment, the location of the connection to the load distribution bar 510 may be substantially at a midpoint of the idler mount 520. The idler mount 520 may axially support, for example, the third idler roller 525*c*.

In an embodiment, the idler shaft 515 and the idler mount 520 may each comprise a substantially rigid material, such as stainless steel, aluminum, and/or another metal, a metallic alloy and/or a rigid plastic that is substantially rigid within an operating temperature range for a document processing device.

Each idler roller 525*a-c* may be aligned with a corresponding drive roller, such as 530*a-c*, respectively. An idler roller, such as 525*a*, may be configured to provide a normal force against a sheet as it is being transported between the idler roller and the corresponding drive roller 530*a*.

As shown in FIG. 5, each drive roller 530*a-c* for a sheet transport roller system 500 may be axially connected to a common drive shaft 535. As such, each drive roller 530*a-c* may have a substantially equal rotational velocity. Alternate embodiments including a plurality of drive shafts may be used within the scope of the present disclosure.

Referring back to FIG. 5, the sheet transport roller system 500 may be configured to apply a substantially equal normal force at each idler roller 525*a-c*. For example, if the factors affecting the normal force at each idler roller 525*a-c* are equal, portions of the load distribution bar 510, the idler shaft 515 and the idler mount 520 may be substantially parallel to the plane in which sheets are transported through the sheet transport roller system 500. In contrast, if the factors affecting the normal force at one or more idler rollers 525*a-c* are such that the normal force applied by at least one idler roller is less than the normal force applied by at least one other idler roller, one or more of the load distribution bar 510, the idler shah 515 and the idler mount 520 may pivot such that the resulting normal force applied at each idler roller is substantially equal. As a result, sheet skew may be limited.

Figure 6:
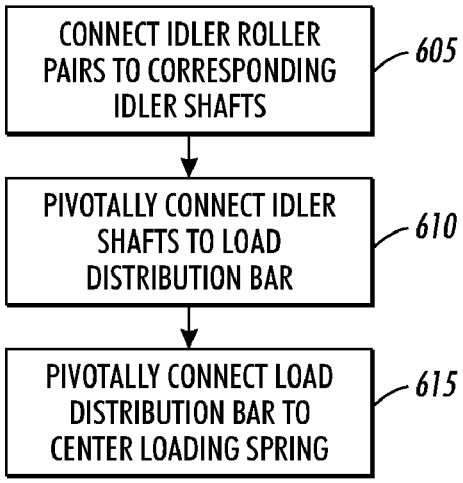
FIG. 6 depicts a flow diagram for an exemplary method of reducing sheet skew in a sheet transport roller system having at least one pair of idler rollers according to an embodiment.

FIG. 6 depicts a flow diagram for an exemplary method of reducing sheet skew in a sheet transport roller system having at least one pair of idler rollers according to an embodiment. As shown in FIG. 6, each pair of idler rollers may be connected 605 to a corresponding idler shaft. Each idler shaft may be configured to apply a substantially equal normal force to each connected idler roller. In an embodiment, each idler roller may be axially connected 605 to the corresponding idler shaft. In an embodiment, a first pair of idler rollers, including a first idler roller and a second idler roller, may be connected 605 to a first idler shaft such that the first idler roller is substantially at a first end of the first idler shaft and the second idler roller is substantially at a second end of the first idler shaft. In an embodiment, a second pair of idler rollers, including a third idler roller and a fourth idler roller, may be connected 605 to a second idler shaft such that the third idler roller is substantially at a first end of the second idler shaft and the fourth idler roller is substantially at a second end of the second idler shaft.

Each idler shaft may be pivotally connected 610 to a load distribution bar. The load distribution bar may be configured to apply a substantially equal normal force to each connected idler shaft. In an embodiment, a first idler shaft may be pivotally connected 610 substantially at a first end of the load distribution bar, and a second idler shaft may be pivotally connected 610 substantially at a second end of the load distribution bar.

The load distribution bar may be pivotally connected 615 to a center loading spring. In an embodiment, the center loading spring may be connected 615 substantially at a midpoint between of the load distribution bar.

Sheet transport roller systems configured as described above in reference to FIG. 6 may provide substantially equal normal forces by each idler roller. As such, a sheet transport roller system incorporating the principles of FIG. 6 may be used to reduce sheet skew when transporting a sheet.

Figure 7:
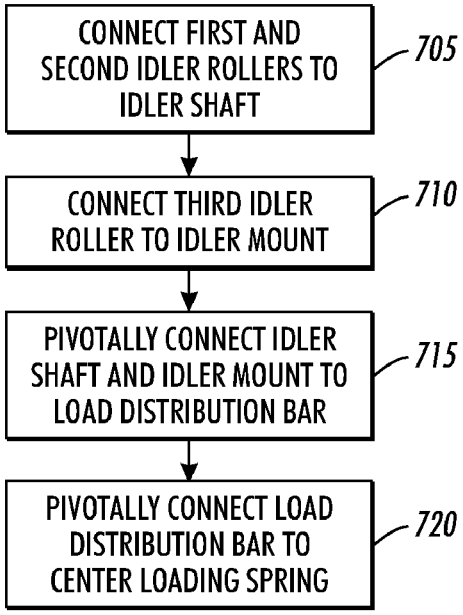
FIG. 7 depicts a flow diagram for an exemplary method of reducing sheet skew in a sheet transport roller system according to an embodiment.

FIG. 7 depicts a flow diagram for an exemplary method of reducing sheet skew in a sheet transport roller system according to an embodiment. As shown in FIG. 7, a first idler rollers and a second idler roller may be connected 705 to an idler shaft. The idler shaft may be configured to apply a substantially equal normal force to the first and second idler rollers. In an embodiment, the first and second idler roller may be axially connected 705 to the idler shaft. In an embodiment, the first and second idler rollers may be connected 705 to the idler shaft such that the first idler roller is connected substantially at a first end of the idler shaft and the second idler roller is connected substantially at a second end of the idler shaft.

A third idler roller may be connected 710 to an idler mount. In an embodiment, an idler mount may be configured to axially support a single idler roller.

The idler shaft and the idler mount may each be pivotally connected 715 to a load distribution bar. The load distribution bar may be configured to apply a substantially equal normal force to each of the first, second and third idler rollers. In an embodiment, the idler shaft may be pivotally connected 715 substantially at a first end of the load distribution bar, and the idler mount may be pivotally connected 715 substantially at a second end of the load distribution bar.

The load distribution bar may be pivotally connected 720 to a center loading spring. In an embodiment, the center loading spring may be connected 720 at a point that is closer to the first end of the load distribution bar (i.e., the end supporting the idler shaft) than the second end of the load distribution bar (i.e., the end supporting the idler mount). The biasing of the center loading spring towards the idler shaft may result in a substantially equal normal force being applied to each idler roller. In an embodiment, the distance along the load distribution bar from the center loading spring to the connection point of the idler mount may be substantially twice the distance along the load distribution bar from the center loading spring to the connection point of the idler shaft.

Sheet transport roller systems configured as described above in reference to FIG. 7 may provide substantially equal normal forces by each idler roller. As such, a sheet transport roller system incorporating the principles of FIG. 7 may be used to reduce sheet skew when transporting a sheet.

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the disclosed embodiments.

What is claimed is:

1. A sheet transport roller system for use in a document processing device, the sheet transport roller system comprising:

a plurality of idler rollers;

a plurality of drive rollers, wherein each drive roller corresponds to a corresponding idler roller; and a load distribution mechanism configured to support the plurality of idler rollers, wherein the load distribution mechanism comprises:

a center loading spring in contact with a portion of the document processing device other than the sheet transport roller system, a load distribution bar pivotally connected to the center loading spring, and a plurality of idler shafts, wherein each idler shaft supports at least two idler rollers, wherein each idler shaft is pivotally connected to the load distribution bar substantially at a midpoint of the idler shaft, wherein the load distribution mechanism is configured to equalize normal forces applied by each idler roller towards the corresponding drive roller.

2. The sheet transport roller system of claim 1 wherein:

the first idler roller of a first idler shaft of the plurality of idler shafts is located substantially at a first end of the first idler shaft;

the second idler roller of the first idler shaft is located substantially at a second end of the first idler shaft;

the first idler roller of a second idler shaft of the plurality of idler shafts is located substantially at a first end of the second idler shaft; and the second idler roller of the second idler shaft is located substantially at a second end of the second idler shaft.

3. The sheet transport roller system of claim 1 wherein each idler shaft is not directly connected to a spring.

4. A sheet transport roller system for use in a document processing device, the sheet transport roller system comprising:

a plurality of idler rollers;

a plurality of drive rollers, wherein each drive roller corresponds to a corresponding idler roller; and a load distribution mechanism configured to support the plurality of idler rollers, wherein the load distribution mechanism comprises:

a center loading spring in contact with a portion of the document processing device other than the sheet transport roller system, a load distribution bar pivotally connected to the center loading spring, and a plurality of idler shafts, wherein each idler shaft supports a first idler roller and a second idler roller, and wherein each idler shaft is pivotally connected to the load distribution bar at a portion of the idler shaft substantially equidistant from the first idler roller and the second idler roller supported by the idler shaft, wherein the load distribution mechanism is configured to equalize normal forces applied by each idler roller towards the corresponding drive roller.

5. The sheet transport roller system of claim 4 wherein:

the first idler roller of a first idler shaft is located substantially at a first end of the first idler shaft;

the second idler roller of the first idler shaft is located substantially at a second end of the first idler shaft;

the first idler roller of a second idler shaft is located substantially at a first end of the second idler shaft; and the second idler roller of the second idler shaft is located substantially at a second end of the second idler shaft.

6. The sheet transport roller system of claim 4 wherein each idler shaft is not connected to the load distribution bar by a spring.

* * * * *